US007497091B2

(12) United States Patent
Yoshimi et al.

(10) Patent No.: US 7,497,091 B2
(45) Date of Patent: Mar. 3, 2009

(54) REFRIGERATION DEVICE

(75) Inventors: Manabu Yoshimi, Osaka (JP); Atsushi Yoshimi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 439 days.

(21) Appl. No.: 10/551,193

(22) PCT Filed: Mar. 31, 2004

(86) PCT No.: PCT/JP2004/004749

§ 371 (c)(1),
(2), (4) Date: Sep. 29, 2005

(87) PCT Pub. No.: WO2004/090442

PCT Pub. Date: Oct. 21, 2004

(65) Prior Publication Data

US 2006/0179873 A1 Aug. 17, 2006

(30) Foreign Application Priority Data

Apr. 2, 2003 (JP) ..... 2003-099013

(51) Int. Cl.
*F25B 43/00* (2006.01)

(52) U.S. Cl. ..... 62/474; 62/149

(58) Field of Classification Search ..... 62/149, 62/195, 401, 470, 474, 475
See application file for complete search history.

(56) References Cited

U.S. PATENT DOCUMENTS 5,018,361 A * 5/1991 Kroll et al. ..... 62/85
5,255,527 A * 10/1993 Paige ..... 62/85
5,327,741 A * 7/1994 Mason et al. ..... 62/149
5,620,502 A * 4/1997 Dunne et al. ..... 95/142
5,875,638 A * 3/1999 Tinsler ..... 62/149
6,244,055 B1 * 6/2001 Hanson et al. ..... 62/85

FOREIGN PATENT DOCUMENTS

| | | | |
|---|---|---|---|
| JP | 58-178166 | A | 10/1983 |
| JP | 62-233652 | A | 10/1987 |
| JP | 2-75858 | A | 3/1990 |
| JP | 10-129245 | A | 5/1998 |
| JP | 2001-41613 | A | 2/2001 |
| JP | 2001-280731 | A | 10/2001 |
| JP | 2002-81808 | A | 3/2002 |
| JP | 2003-042603 | A | 2/2003 |

* cited by examiner

*Primary Examiner*—Melvin Jones
(74) *Attorney, Agent, or Firm*—Birch, Stewart, Kolasch & Birch, LLP

(57) ABSTRACT

Disposed is a contaminant recovery receptacle (40) which is connected, through an inflow pipe (42) and an outflow pipe (43), to the suction side of a compressor (21). The inflow pipe (42) has an exit end which opens towards the inner bottom of the recovery receptacle (40). The outflow pipe (43) has an entrance end which is situated above the exit end of the inflow pipe (42) in the recovery receptacle (40). Firstly, a preliminary operation is carried out which causes refrigerant to circulate in a refrigerant circuit (10) for a predetermined length of time so that gas-liquid two-phase refrigerant flows into the recovery receptacle (40). Thereafter, a recovery operation is carried out, which causes refrigerant to circulate in the refrigerant circuit (10) so that gas refrigerant flows into the recovery receptacle (40). As a result, contaminants are recovered in the recovery receptacle (40).

7 Claims, 8 Drawing Sheets

REFRIGERATION DEVICE

TECHNICAL FIELD

This invention generally relates to refrigeration apparatuses, and it relates more specifically to a refrigeration apparatus having a refrigerant circuit which enables a refrigerant-pipe cleaning operation.

BACKGROUND ART

Conventionally, refrigeration apparatuses, such as an air conditioning apparatus with a refrigerant circuit in which refrigerant circulates to perform a vapor compression refrigeration cycle, use refrigerants of the CFC (chlorofluorocarbon) family or refrigerants of the HCFC (hydrochlorofluorocarbon) family. However, the use of these refrigerants of the CFC/HCFC families gives rise to environmental problems such as ozone layer destruction. It is desired that these existing refrigeration apparatuses are renewed to new ones that employ refrigerants of the HFC (hydrofluorocarbon) family or refrigerants of the HC (hydrocarbon) family.

Refrigerant pipes for establishing connections between a heat source unit and utilization units are practically buried into inner areas of a building, therefore impeding replacement of such buried refrigerant pipes with new ones. For the purpose of shortening work periods and cutting costs down, the introduction of new refrigeration apparatuses is made while utilizing existing refrigerant pipes as they are.

Apart from the above, contaminants (e.g., refrigeration oil used in conventional refrigeration apparatuses employing CFC- or HCFC-family refrigerants with a chlorine content) remain as residual materials in existing refrigerant pipes. Conventionally, naphthenic mineral oil is often used as a refrigeration oil. If naphthenic mineral oil remaining as a residual material in an existing pipe degrades, this may give rise to the problem of corrosion of for example an expansion valve by the presence of chlorine ions and acids in the degraded mineral oil.

Accordingly when introducing a new refrigeration apparatus, it is necessary to clean existing refrigerant pipes to remove residual contaminants in the existing refrigerant pipes, prior to performing a test run on the new refrigeration apparatus.

To this end, there is proposed a refrigeration apparatus equipped with a refrigerant circuit which enables execution of an operation of cleaning existing refrigerant pipes (see, for example, Patent Document 1, Japanese Patent Laid-open Publication No. JP 2001-41613). The refrigeration apparatus of Patent Document 1, Japanese Patent Laid-open Publication No. JP 2001-41613 is provided with a refrigerant circuit formed by connection of a heat source machine mainly made up of a compressor and a heat source side heat exchanger with an indoor unit having a utilization side heat exchanger through existing connection pipes. And, an oil recovery unit for separating contaminants (such as residual refrigeration oil) from the refrigerant and recovering them is provided in a suction side pipe of the compressor.

The refrigeration apparatus of Patent Document 1 is configured, such that after the fill-up of the refrigerant circuit with a refrigerant of the HFC family, the compressor is activated and the refrigeration apparatus operates in cooling mode or in heating mode; existing connection pipes are cleaned by the refrigerant circulating in the refrigerant circuit; and contaminants (such as residual refrigeration oil) are recovered in the oil recovery unit.

Problems that Invention Intends to Solve

The oil recovery unit of the above-described refrigeration apparatus is equipped with a filter unit made up of a microporous member for separating contaminants (residual refrigeration oil) from the refrigerant entered into the oil recovery unit and an adsorptive material for recovering the separated contaminants.

It, however, suffices if contaminants in refrigerant pipes are recovered to such an extent that after renewal, there occurs no serious trouble during the normal operation.

The problem with the oil recovery unit is that its structure becomes complicated as a result of obtaining higher-than-necessary levels of contaminant separation/recovery performance.

With the above problems in mind, the present invention was made. Accordingly, an object of the present invention is to provide a refrigeration apparatus equipped with a structure-simplified oil recovery unit capable of moderate separation/recovery of contaminants without interfere with the normal operation.

DISCLOSURE OF INVENTION

More specifically, a first invention of the present application is directed to a refrigeration apparatus, comprising (a) a refrigerant circuit (10) for execution of a vapor compression refrigeration cycle including a compressor (21), a heat source side heat exchanger (24), and a utilization side heat exchanger (33) which are connected by a refrigerant pipe and (b) a contaminant recovery receptacle (40) which is connected to the suction side of the compressor (21) by an inflow pipe (42) and an outflow pipe (43), for recovering contaminants in the recovery receptacle (40) by causing refrigerant to circulate in the refrigerant circuit (10) so that gaseous refrigerant flows into the recovery receptacle (40). In the refrigeration apparatus of the first invention, the inflow pipe (42) has an exit end which opens downwardly or obliquely downwardly in the recovery receptacle (40) while, on the other hand, the outflow pipe (43) has an entrance end which is situated above the exit end of the inflow pipe (42) in the recovery receptacle (40).

In the first invention, by the circulating of refrigerant in the refrigerant circuit (10), contaminants in the refrigerant pipe are forced to flow, together with gas refrigerant, into the recovery receptacle (40) by way of the inflow pipe (42) and, as a result, the refrigerant pipe is cleaned.

As described above, the exit end of the inflow pipe (42) opens either downwardly or obliquely downwardly in the recovery receptacle (40) and, on the other hand, the entrance end of the outflow pipe (43) is situated above the exit end of the inflow pipe (42) in the recovery receptacle (40). As a result of such arrangement, the gas refrigerant entered into the recovery receptacle (40) by way of the inflow pipe (42) will not flow directly into the outflow pipe (43), but it is introduced towards the inner bottom of the recovery receptacle (40) without fail. Since the flow velocity of the gas refrigerant introduced towards the inner bottom of the recovery receptacle (40) is slower than the circulation flow velocity in the refrigerant circuit (10), contaminants are separated and removed from the gas refrigerant, and only the gas refrigerant is flowed out into the refrigerant circuit (10) by way of the outflow pipe (43).

In addition, a second invention according to the first invention is disclosed which is characterized in that a baffle plate (44) against contaminants is so disposed as to be situated face to face with the entrance end of the outflow pipe (43) at a predetermined distance apart therefrom in the recovery receptacle (40).

In the second invention, it is ensured that the inflow of contaminants (separated from the gas refrigerant introduced to the inner bottom of the recovery receptacle (40)) into the outflow pipe (43) due to rebounding is prevented.

In addition, a third invention according to the first invention is disclosed which is characterized in that it comprises a switching means (50) for switching the circulation of refrigerant in the refrigerant circuit (10) so that the refrigerant is either circulated to flow through the recovery receptacle (40), or circulated to bypass the recovery receptacle (40), wherein the switching means (50) is made up of opening/closing valves (51, 52) disposed, respectively, in the inflow and outflow pipes (42, 43) of the recovery receptacle (40), and an opening/closing valve (53) disposed between a connection part of the inflow pipe (42) and a connection part of the outflow pipe (43) of the recovery receptacle (40) in a refrigerant pipe on the suction side of the compressor (21).

In the third invention, it is arranged that during the pipe cleaning operation, the opening/closing valves (51, 52) each change state to the open state while, on the other hand, the opening/closing valve (53) changes state to the closed state, whereby the refrigerant is circulated in the refrigerant circuit (10) so that it flows through the recovery receptacle (40). And, during the normal operation after the pipe cleaning operation has been completed, the opening/closing valves (51, 52) each change state to the closed state while, on the other hand, the opening/closing valve (53) changes state to the open state, whereby the refrigerant is circulated in the refrigerant circuit (10) so that it bypasses the recovery receptacle (40). As a result, the refrigerant is circulated, such that it will never flow through the recovery receptacle (40) during the normal operation, and the operation of the refrigeration apparatus is carried out safely.

In addition, a fourth invention according to the first invention is disclosed which is characterized in that an auxiliary liquid for the recovery of contaminants is pre-stored in the recovery receptacle (40), and that the exit end of the inflow pipe (42) of the recovery receptacle (40) is situated at a predetermined distance apart from the storage surface of the contaminant-recovery auxiliary liquid.

In the fourth invention, contaminants contained in gas refrigerant introduced to the inner bottom of the recovery receptacle (40) are attracted by attraction force (surface tension) in the storage surface of the contaminant recovery auxiliary liquid. This assures separation of contaminants from gas refrigerant introduced to the inner bottom of the recovery receptacle (40).

Since the exit end of the inflow pipe (42) is positioned at a predetermined distance away from the storage surface of the contaminant-recovery auxiliary liquid, this prevents gas refrigerant from being discharged, through the inflow pipe (42), into the contaminant-recovery auxiliary liquid. As a result, gas refrigerant entered into the recovery receptacle (40) is flowed out into the refrigerant circuit (10) by way of the outflow pipe (43), and the increase in gas refrigerant's pressure loss in the recovery receptacle (40) is prevented.

In addition, a fifth invention according to the first invention is disclosed which is characterized in that it comprises a preliminary operation means (60) for causing refrigerant to circulate in the refrigerant circuit (10) for a predetermined length of time so that a two-phase refrigerant mixture of liquid refrigerant and gas refrigerant flows into the recovery receptacle (40), and a recovery operation means (70) for causing refrigerant to circulate in the refrigerant circuit (10) so that upon completion of the operation of the preliminary operation means (60), gaseous refrigerant flows into the recovery receptacle (40).

In the fifth invention, liquid refrigerant and contaminants are separated from a so-called two-phase refrigerant mixture of liquid refrigerant and gas refrigerant flowed into the recovery receptacle (40) by the preliminary operation means (60), and the separated liquid refrigerant and contaminants are stored in the recovery receptacle (40). Stated another way, this is the same state as the state that the contaminant-recovery auxiliary liquid is stored in the recovery receptacle (40) in the fourth invention.

And, upon completion of the operation of the preliminary operation means (60), contaminants present in the gas refrigerant introduced to the inner bottom of the recovery receptacle (40) by the recovery operation means (70) are attracted to the storage surface of the stored liquid refrigerant. Accordingly, it is ensured that contaminants are separated from gas refrigerant introduced to the inner bottom of the recovery receptacle (40).

In addition, a sixth invention according to the fifth invention is disclosed which is characterized in that the preliminary operation means (60) increases the degree of opening of an expansion valve (32) disposed between the heat source side heat exchanger (24) and the utilization side heat exchanger (33).

In the sixth invention, the liquid refrigerant entered into the expansion valve (32) is less restricted than in the normal operation, and the amount of refrigerant in the utilization side heat exchanger (33) increases. As a result, a part of refrigerant entered into the utilization side heat exchanger (33) is left unvaporized and remains still in the form of liquid refrigerant. This ensures that a gas-liquid two-phase refrigerant mixture of liquid refrigerant and gas refrigerant flows into the recovery receptacle (40), thereby assuring the storage of liquid refrigerant in the recovery receptacle (40).

In addition, a seventh invention according to the fifth invention is disclosed which is characterized in that the preliminary operation means (60) stops a utilization side fan of the utilization side heat exchanger (33).

In the seventh invention, a supply of air as a heat transfer medium is not provided to the utilization side heat exchanger (33) and, as a result, the evaporation amount of refrigerant in the utilization side heat exchanger (33) is reduced. This assures inflow of a gas-liquid two-phase refrigerant mixture of liquid refrigerant and gas refrigerant into the recovery receptacle (40), as in the sixth invention. Consequently, it is ensured that liquid refrigerant is stored in the recovery receptacle (40).

Finally, an eighth invention according to the fifth invention is disclosed which is characterized in that the preliminary operation means (60) lowers the frequency of the compressor (21) to below a predetermined value.

In the eighth invention, the amount of refrigerant drawn into the compressor (21) is reduced and, as a result, the amount of refrigerant in the utilization side heat exchanger (33) increases. In other words, this is the state in which the degree of opening of the expansion valve (32) apparently increases, thereby assuring inflow of a gas-liquid two-phase refrigerant mixture of gas refrigerant and liquid refrigerant into the recovery receptacle (40).

Effects of Invention

As described above, in accordance with the present invention, the recovery receptacle (40) is provided in the refrigerant circuit (10), and refrigerant is circulated through the refrigerant circuit (10) so that gas refrigerant flows into the recovery receptacle (40), whereby the refrigerant pipe is cleaned.

Especially, in accordance with the first invention, it is arranged that the exit end of the inflow pipe (42) opens downwardly or obliquely downwardly in the recovery receptacle (40) while, on the other hand, the entrance end of the outflow pipe (43) is situated above the exit end of the inflow pipe (42). As a result of such arrangement, gas refrigerant discharged from the inflow pipe (42) is not entered directly into the outflow pipe (43), but it is discharged towards the inner bottom of the recovery receptacle (40), and contaminants are separated from the gas refrigerant. Then, only the gas refrigerant is flowed out through the outflow pipe (43). The recovery receptacle (40) has a function of separating contaminants from gas refrigerant and colleting the separated contaminants, and is simple in structure.

In addition, in accordance with the second invention, it is arranged that the baffle plate (44) is disposed face to face with the entrance end of the outflow pipe (43) at a predetermined distance apart therefrom in the recovery receptacle (40). Such arrangement prevents outflow of contaminants, introduced into the recovery receptacle (40) together with gas refrigerant and then separated from the gas refrigerant, through the outflow pipe (43) due to rebounding. This therefore ensures that contaminants are recovered in the recovery receptacle (40) without fail.

In addition, in accordance with the third invention, it is arranged that the switching means (50) is made up of the opening/closing valves (51, 52) disposed respectively in the inflow and outflow pipes (42, 43) of the recovery receptacle (40), and the opening/closing valve (53) disposed between the connection part of the inflow pipe (42) and the connection part of the outflow pipe (43) of the recovery receptacle (40) in the refrigerant pipe on the suction side of the compressor (21). As a result of such arrangement, during the normal operation after completion of the pipe cleaning, refrigerant can be circulated in the refrigerant circuit (10) without flowing through the recovery receptacle (40). Consequently, contaminants are confined in the recovery receptacle (40), thereby making it possible to safely carry out normal operations.

In addition, in accordance with the fourth invention, it is arranged that contaminant recovery auxiliary liquid is prestored in the recovery receptacle (40). In accordance with the fifth invention, refrigerant is circulated in the refrigerant circuit (10) so that a two-phase refrigerant mixture of liquid refrigerant and gas refrigerant flows into the recovery receptacle (40). As the result of such arrangements, contaminants contained in gas refrigerant entered into the recovery receptacle (40) are attracted to the surface of the contaminant recovery auxiliary liquid and adhered thereto. It is ensured that the contaminants are separated from the gas refrigerant and then collected in the recovery receptacle (40).

In addition, in accordance with the sixth invention, it is arranged that the degree of opening of the expansion valves (25 (32)) is made greater than normal by the preliminary operation means (60). In accordance with the seventh invention, it is arranged that the utilization side fan is stopped by the preliminary operation means (60). In accordance with the eighth invention, it is arranged that the frequency of the compressor (21) is reduced to less than a predetermined value. As the result of such arrangements, either the amount of refrigerant in the utilization side heat exchanger (33) is increased or the evaporation amount of refrigerant in the utilization side heat exchanger (33) is decreased. It is ensured that refrigerant flowing past the utilization side heat exchanger (33) is circulated in a gas-liquid two-phase state. This therefore ensures storage of liquid refrigerant in the recovery receptacle (40).

BEST MODE FOR CARRYING OUT INVENTION

Figure 1:
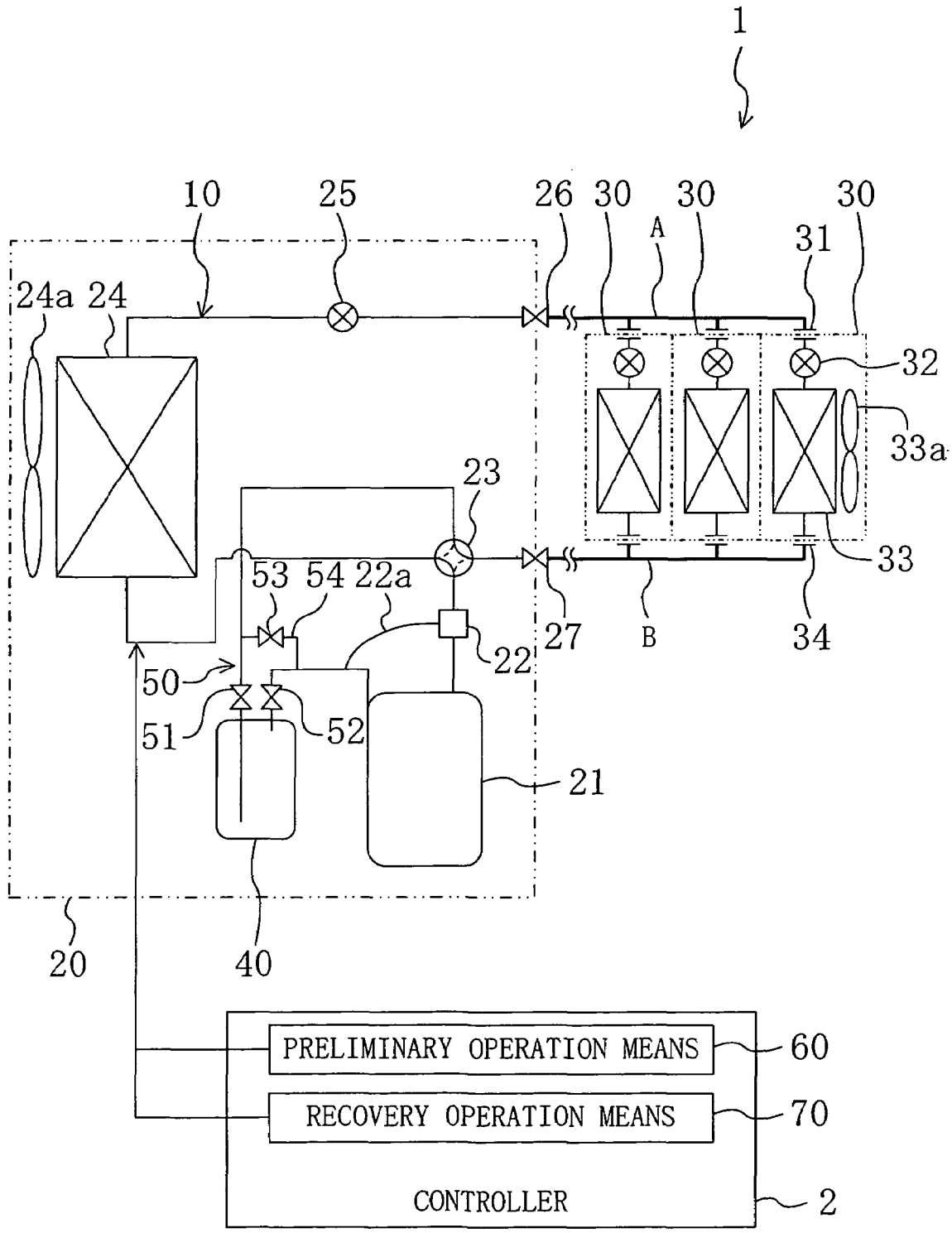
FIG. 1 is a refrigerant circuit diagram of an air conditioning apparatus according to a first embodiment of the present invention.

Hereinafter, embodiments of the present invention will be described in detail with reference to the drawing figures.

Embodiment 1 of Invention

Referring to FIG. 1, there is shown a refrigeration apparatus (1) of a first embodiment of the present invention. The refrigeration apparatus (1) is provided with a refrigerant circuit (10) through which refrigerant is circulated for execution of a vapor compression refrigeration cycle.

The refrigerant circuit (10) includes an outdoor unit (20) which is a heat source unit and a plurality of indoor units (30) (three indoor units (30) in the first embodiment) which are utilization side units. The outdoor unit (20) is connected to the indoor units (30) by existing pipes, namely a liquid pipe (A) and a gas pipe (B). And, the outdoor unit (20) and the indoor units (30) are renewed units using a refrigerant of the HFC family.

The three indoor units (30) are connected in parallel to respective refrigerant pipes branched off from the liquid pipe (A) and to respective refrigerant pipes branched off from the gas pipe (B). Each indoor unit (30) is formed by piping connection of an indoor expansion valve (32) which is an expansion valve and an indoor heat exchanger (33) which is a utilization side heat exchanger. In addition, one of the indoor heat exchangers (33) is provided with an indoor fan (33*a*) which is a utilization side fan.

The outdoor unit (20) is formed by sequential piping connection of a compressor (21), an oil separator (22), a four-way switching valve (23), an outdoor heat exchanger (24) which is a heat source side heat exchanger, and an outdoor expansion valve (25). In addition, the outdoor heat exchanger (24) is provided with an outdoor fan (24*a*).

A first closing valve (26) which is a flowpath opening/closing means is provided at an end of a pipe on the side of the outdoor expansion valve (25) in the outdoor unit (20), and one end of the liquid pipe (A) is connected, through the first closing valve (26), to the pipe end. On the other hand, a second closing valve (27) which is a flowpath opening/closing means is provided at an end of a pipe on the side of the four-way switching valve (23) in the outdoor unit (20), and one end of the gas pipe (B) is connected, through the second closing valve (27), to the pipe end.

The other end of the liquid pipe (A) is connected, through a connection implement (31), such as a flare joint, to an end of a pipe on the side of the indoor expansion valve (32) in each indoor unit (30). On the other hand, the other end of the gas pipe (B) is connected, through a connection implement (34), such as a flare joint, to an end of a pipe on the side of the indoor heat exchanger (33) in each indoor unit (30).

The refrigerant circuit (10) is configured, such that it is selectively operated in cooling mode and in heating mode by the switching of the four-way switching valve (23). In other words, if the four-way switching valve (23) changes state to a first state (indicated by solid lines in FIG. 1), this causes refrigerant to circulate in the refrigerant circuit (10) in cooling mode of operation in which refrigerant condensation takes place in the outdoor heat exchanger (24). On the other hand, if the four-way switching valve (23) changes state to a second state (indicated by dashed lines in FIG. 1), this causes refrigerant to circulate in the refrigerant circuit (10) in heating mode of operation in which refrigerant evaporation takes place in the outdoor heat exchanger (24).

For example, in the heating mode of operation, separation/removal of oil from refrigerant compressed in the compressor (21) is carried out by an oil separator (22). The refrigerant is condensed in the outdoor heat exchanger (24). Thereafter, the refrigerant passes through the outdoor expansion valve (25) and expands in each indoor expansion valve (32). Then, the refrigerant is evaporated in each indoor heat exchanger (33), and is brought back again to the compressor (21). Such a refrigerant circulation is repeatedly carried out.

In the outdoor unit (20), the refrigerant circuit (10) is provided with a recovery receptacle (40) for collecting contaminants. The recovery receptacle (40) is connected to a refrigerant pipe between the suction side of the compressor (21) and the four-way switching valve (23) by an inflow pipe (42) and an outflow pipe (43). An inflow valve (51) and an outflow valve (52) which are opening/closing valves are disposed in the inflow pipe (42) and in the outflow pipe (43), respectively.

In addition, the refrigerant circuit (10) is provided with a bypass pipe (54) which is a pipe for bypassing the recovery receptacle (40). One end of the bypass pipe (54) is connected between the suction side of the compressor (21) and the outflow pipe (43) of the recovery receptacle (40) while, on the other hand, the other end of the bypass pipe (54) is connected between the four-way switching valve (23) and the inflow pipe (42) of the recovery receptacle (40). A bypass valve (53) which is an opening/closing valve is provided in the bypass pipe (54). And, the inflow valve (51), the outflow valve (52), and the bypass valve (53) together constitute a switching means (50).

The refrigerant circuit (10) switches the switching means (50) in cooling mode of operation for pipe cleaning. More specifically, the inflow valve (51) and the outflow valve (52) are placed in the open state while, on the other hand, the bypass valve (53) is placed in the closed state. This causes refrigerant to circulate through the inflow pipe (42), the recovery receptacle (40), and the outflow pipe (43). Then, the refrigerant circuit (10) switches the switching means (50) during the normal operation after completion of the pipe cleaning. More specifically, the inflow valve (51) and the outflow valve (52) are placed in the closed state while, on the other hand, the bypass valve (53) is placed in the open state. This allows refrigerant to circulate through the bypass pipe (54) without passing through the recovery receptacle (40).

In addition, one end of an oil return pipe (22*a*) is connected to the oil separator (22). The other end of the oil return pipe (22*a*) is connected to a pipe part on the suction side of the compressor (21) and on the downstream side of the recovery receptacle (40). The oil return pipe (22*a*) is configured so that refrigeration oil for the HFC family refrigerant separated and removed in the oil separator (22) flows towards the suction side of the compressor (21) from the oil separator (22).

The refrigerant circuit (10) is controlled by a controller (2). The controller (2) has a preliminary operation means (60) and a recovery operation means (70). The preliminary operation means (60) causes refrigerant to circulate in the refrigerant circuit (10) for a predetermined length of time so that a two-phase refrigerant mixture of liquid refrigerant and gas refrigerant flows into the recovery receptacle (40). On the other hand, the recovery operation means (70) causes refrigerant to circulate in the refrigerant circuit (10) so that upon completion of the operation of the preliminary operation means (60), gaseous refrigerant flows into the recovery receptacle (40).

Figure 2:
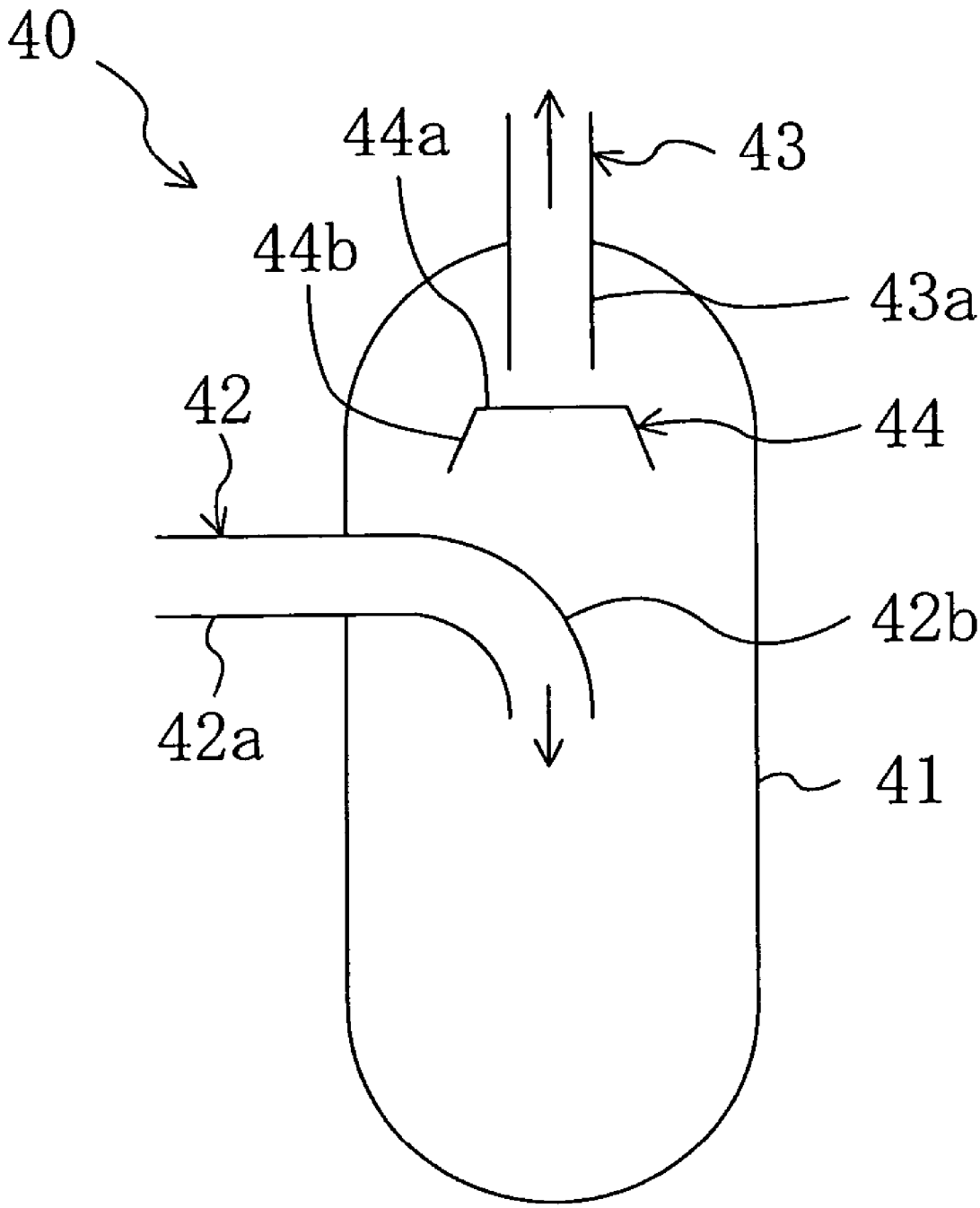
FIG. 2 shows in cross section a schematic structure of a recovery receptacle according to the first embodiment.

As shown in FIG. 2, the recovery receptacle (40) includes a hermetically-sealed casing (41). This casing (41) is shaped like a cylinder extending vertically. The inflow pipe (42) is connected to an upper side surface portion of the casing (41) while, on the other hand, the outflow pipe (43) is connected to an upper central portion of the casing (41).

The inflow pipe (42) has a straight pipe part (42*a*) which extends horizontally. The straight pipe part (42*a*) passes completely through a sidewall portion of the casing (41), and is introduced into the casing (41). The straight pipe part (42*a*) includes, at an inner end thereof, a downwardly curved part (42*b*) formed continuously to the inner end. A lower end of the curved part (42*b*) serves as an exit end. The exit end is situated centrally in the casing (41).

On the other hand, the outflow pipe (43) has a straight pipe part (43*a*) which extends vertically. The straight pipe part (43*a*) passes completely through an upper wall portion of the casing (41), and is introduced into the casing (41). A lower end of the straight pipe part (43*a*) serves as an entrance end. The entrance end is situated at an upper part in the casing (41). That is, the exit end of the inflow pipe (42) opens towards the inner bottom of the recovery receptacle (40) without facing the opening of the entrance end of the outflow pipe (43), in other words the exit end of the inflow pipe (42) is formed, such that it is oriented in the same direction as the opening of the entrance end of the outflow pipe (43). In addition, the entrance end of the outflow pipe (43) is situated above the exit end of the inflow pipe (42) in the recovery receptacle (40).

A baffle plate (44) shaped like an up-side down dish is provided in the recovery receptacle (40). The baffle plate (44) includes a horizontal member (44*a*) shaped like a flat plate. The horizontal member (44*a*) has an inclined member (44*b*) extending, at a slant, downwardly outwardly from each edge. The baffle plate (44) is disposed, such that it faces the lower end of the outflow pipe (43) at a predetermined distance apart therefrom. Stated another way, the baffle plate (44) is configured so that contaminants introduced into the recovery receptacle (40) together with gas refrigerant and separated therefrom are prevented from flowing out through the outflow pipe (43) due to rebounding.

Only the inflow pipe (42), the outflow pipe (43), and the baffle plate (44) are disposed as the componentry within the casing (41) of the recovery receptacle (40) in the first embodiment.

Running Operation

Next, a method of replacing the indoor and outdoor units (20, 30) with new ones is first described briefly. Then, the running operation of the air conditioning apparatus (1) during pipe cleaning is described.

Method of Replacing Indoor and Outdoor Units

A replacement method, in which for renewal of an existing air conditioning apparatus (1) employing a CFC- or HCFC-family refrigerant, existing liquid and gas pipes (A, B) are utilized intact while existing outdoor and indoor units (20, 30) are replaced with new outdoor and indoor units (20, 30), will be described below.

In the first place, the old refrigerant of the CFC- or HCFC-family is collected from the existing air conditioning apparatus (1). With the existing liquid and gas pipes (A, B) left intact, the existing outdoor and indoor units (20, 30) are disconnected from connection implements (31, 34) such as flare joints and from closing valves (26, 27). Thereafter, new outdoor and indoor units (20, 30) are installed and then are connected, through the connection implements (31, 34) and the closing valves (26, 27), to the existing liquid and gas pipes (A, B), thereby to constitute the refrigerant circuit (10).

The newly installed outdoor unit (20) is already filled up with HFC-family refrigerant as a new refrigerant. Therefore, both the first closing valve (26) and the second closing valve (27) are placed in the closed state, and a vacuum is drawn in the indoor unit (30), the liquid pipe (A), and the gas pipe (B), and air, moisture, and so on present in the units of the refrigerant circuit (10) except the outdoor unit (20) are removed. Then, both the first closing valve (26) and the second closing valve (27) are placed in the open state, and the refrigerant circuit (10) is additionally filled up with HFC-family refrigerant.

Operation during Pipe Cleaning

Next, a pipe cleaning operation, for removal of refrigeration oil for the old refrigerant remaining especially in the existing liquid and gas pipes (A, B) in the air conditioning apparatus (1), will be described below.

The pipe cleaning operation is an operation which is carried out in cooling mode of the air conditioning apparatus (1), in other words, the pipe cleaning operation is carried out when the four-way switching valve (23) is placed in the state indicated by solid lines in FIG. 1. The pipe cleaning operation is made up of a first operation (hereinafter called "preliminary operation") for causing refrigerant to circulate in the refrigerant circuit (10) so that gas-liquid two-phase refrigerant flows into the recovery receptacle (40), and a second operation (hereinafter called "recovery operation) which is carried out upon completion of the preliminary operation for causing refrigerant to circulate in the refrigerant circuit (10) so that gas refrigerant flows into the recovery receptacle (40).

(A) Preliminary Operation

Firstly, the description will be made on the preliminary operation. The preliminary operation is carried out by control from the preliminary operation means (60).

With the compressor (21) of the refrigerant circuit (10) stopped, the inflow valve (51) and the outflow valve (52) are placed in the open state while, on the other hand, the bypass valve (53) is placed in the closed state. And, the degree of opening of the outdoor expansion valve (25) is set, such that it is fully opened, and the degree of opening of each indoor expansion valve (32) is set greater than usual.

When in the above-described state of the refrigerant circuit (10), the compressor (21) is activated, gas refrigerant compressed in the compressor (21) is discharged, together with refrigeration oil for the HFC-family refrigerant and they flow into the oil separator (22). In the oil separator (22), the refrigeration oil for the HFC-family refrigerant is separated. The gas refrigerant flows into the outdoor heat exchanger (24) by way of the four-way switching valve (23), exchanges heat with outside air taken in by the outdoor fan (24*a*), and is condensed into a liquid refrigerant.

The condensed liquid refrigerant flows into each indoor expansion valve (32) by way of the outdoor expansion valve (25), the first closing valve (26), and the liquid pipe (A). Since the degree of opening of each indoor expansion valve (32) is so set as to be greater than normal, the amount of refrigerant flowing into each indoor heat exchanger (33) becomes greater than that in the normal operation. Consequently, most of the liquid refrigerant entered into each indoor heat exchanger (33) exchanges heat with indoor air taken in by the indoor fan (33*a*), and is evaporated into a gas refrigerant: however, a part of the liquid refrigerant is left unvaporized, remaining still in a liquid state. Stated another way, refrigerant flowing and passing through each indoor heat exchanger (33) becomes a gas-liquid two-phase refrigerant mixture of liquid refrigerant and gas refrigerant. The gas-liquid two-phase refrigerant flows into the recovery receptacle (40) by way of the gas pipe (B), the second closing valve (27), and the four-way switching valve (23).

The gas-liquid two-phase refrigerant entered into the recovery receptacle (40) flows and passes through the inflow pipe (42), and is discharged towards the inner bottom of the casing (41). The flow velocity of the discharged refrigerant is lower than the circulation flow velocity of refrigerant in the refrigerant circuit (10), so that liquid refrigerant is separated from the gas-liquid two-phase refrigerant and is stored at the inner bottom of the casing (41). Then, only gas refrigerant is brought back to the refrigerant circuit (10) by way of the outflow pipe (43). The gas refrigerant is again drawn into the compressor (21).

Then, a preliminary operation accompanied by the above-described refrigerant circulation is performed for a predetermined length of time. For example, the predetermined length of time is the time by which a level sensor (not shown) provided in the recovery receptacle (40) stops, after detecting that the casing (41) is filled with liquid refrigerant to a predetermined level, the compressor (21).

To sum up, by virtue of the preliminary operation, it becomes possible to fill the recovery receptacle (40) with liquid refrigerant to a predetermined level.

Recovery Operation

Next, the description will be made on the recovery operation. The recovery operation is carried out upon completion of the preliminary operation by control from the recovery operation means (70).

Firstly, with the switching means (50) placed in the same state as in the preliminary operation, the degree of opening of each indoor expansion valve (32) is set to the normal opening degree at normal operation time. When, in the above state of the refrigerant circuit (10), the compressor (21) is activated, refrigerant entered into each expansion valve (32) undergoes decompression, exchanges heat with indoor air in the indoor heat exchanger (33), and is evaporated into a gas refrigerant. The gas refrigerant flows into the recovery receptacle (40) by way of the gas pipe (B), the second closing valve (27), and the four-way switching valve (23).

By virtue of the above-described refrigerant circulation, contaminants, e.g., refrigeration oil for the old refrigerant lingering in refrigerant pipes (especially, the liquid pipe (A) and the gas pipe (B)) are taken away therefrom, and flow into the recovery receptacle (40), together with the refrigerant. Thereby, the refrigerant pipes are cleaned.

The gas refrigerant entered into the recovery receptacle (40) flows and passes through the inflow pipe (42), and is discharged towards the inner bottom of the casing (41). Since the flow velocity of the refrigerant thus discharged falls below the circulation flow velocity of refrigerant in the refrigerant circuit (10), contaminants, such as refrigeration oil, are separated from the gas refrigerant, and are stored in the recovery receptacle (40). Here, the liquid refrigerant is already stored in the recovery receptacle (40) by the above-described preliminary operation, so that contaminants entered into the recovery receptacle (40) adhere onto the surface of the liquid refrigerant by suction at the surface of the liquid refrigerant. This ensures that contaminants are separated from gas refrigerant entered into the recovery receptacle (40) and are stored in the recovery receptacle (40). And only gas refrigerant flows out into the refrigerant circuit (10) by way of the outflow pipe (43), and is again drawn into the compressor (21). Such a refrigerant circulation is repeatedly carried out. Thereby, contaminants in the refrigerant pipes are collected in the recovery receptacle (40).

In addition, for example, even if, when gas refrigerant is discharged towards the inner bottom of the recovery receptacle (40) from the inflow pipe (42), contaminants separated from the gas refrigerant rebound upwardly to near the entrance end of the outflow pipe (43), the contaminants will not flow out from the outflow pipe (43) because of the baffle plate (44) as an obstacle against the contaminants. It is ensured that contaminants in the refrigerant pipes are collected in the recovery receptacle (40).

Upon completion of the above-described recovery operation, the inflow valve (51) and the outflow valve (52) are placed in the closed state while, on the other hand, the bypass valve (53) is placed in the open state. Thereafter, the normal operation is enabled, and the refrigerant circulates in the refrigerant circuit (10) without passing and flowing through the recovery receptacle (40).

Effects of Embodiment

As described above, in accordance with the first embodiment, the refrigerant circuit (10) is provided with the recovery receptacle (40), and the switching means (50) is switched for refrigerant to circulate in the refrigerant circuit (10) so that gas refrigerant flows into the recovery receptacle (40) in cooling mode of operation, thereby making it possible to clean the refrigerant pipes.

In addition, it is arranged that the exit end of the inflow pipe (42) in the recovery receptacle (40) opens towards the inner bottom of the recovery receptacle (40) while, on the other hand, the entrance end of the outflow pipe (43) is disposed so as to be positioned above the exit end of the inflow pipe (42) in the recovery receptacle (40). This arrangement ensures that gas refrigerant which has entered the recovery receptacle (40) is discharged towards the inner bottom of the recovery receptacle (40) without direct inflow into the outflow pipe (43). And, contaminants are separated from the gas refrigerant by the drop in flow velocity of the gas refrigerant, thereby ensuring that only gas refrigerant is flowed out from the outflow pipe (43).

Besides, it is arranged that the baffle plate (44) is disposed to be positioned face to face with the entrance end of the outflow pipe (43) at a predetermined distance apart therefrom in the recovery receptacle (40). As a result of such arrangement, even if, when the gas refrigerant is discharged towards the inner bottom of the recovery receptacle (40) from the inflow pipe (42), contaminants separated from the gas refrigerant rebound upwardly to near the entrance end of the outflow pipe (43), the contaminants will not flow out from the outflow pipe (43). This ensures that the contaminants in the refrigerant pipes are recovered in the recovery receptacle (40).

Additionally, it is arranged that prior to execution of the recovery operation, a preliminary operation is carried out for refrigerant to circulate in the refrigerant circuit (10) so that gas-liquid two-phase refrigerant flows into the recovery receptacle (40) for the pre-storing of liquid refrigerant in the recovery receptacle (40). As a result of such arrangement, contaminants contained in the gas refrigerant which has entered the recovery receptacle (40) is attraction-adhered to the liquid surface of the liquid refrigerant. This assures separation of contaminants from gas refrigerant which has entered the recovery receptacle (40), and the contaminants are stored in the recovery receptacle (40).

Furthermore, it is arranged that the refrigerant circuit (10) is provided with the switching means (50). As a result of such arrangement, by switching the switching means (50) in the normal operation upon completion of the process of pipe cleaning, it becomes possible to cause refrigerant to circulate, without flowing through the recovery receptacle (40), in the refrigerant circuit (10) and to confine the collected contaminants within the recovery receptacle (40). This makes it possible to safely perform the normal operation.

In addition, in the preliminary operation, it is arranged that the degree of opening of each indoor expansion valve (32) is set greater than in the normal operation. Such arrangement ensures that refrigerant which has flowed through the indoor heat exchanger (33) flows in the form of a gas-liquid two-phase refrigerant, thereby ensuring that liquid refrigerant is stored in the recovery receptacle (40).

Embodiment 2 of Invention

Next, a second embodiment of the present invention will be described in detail with reference to the drawing figures.

Figure 3:
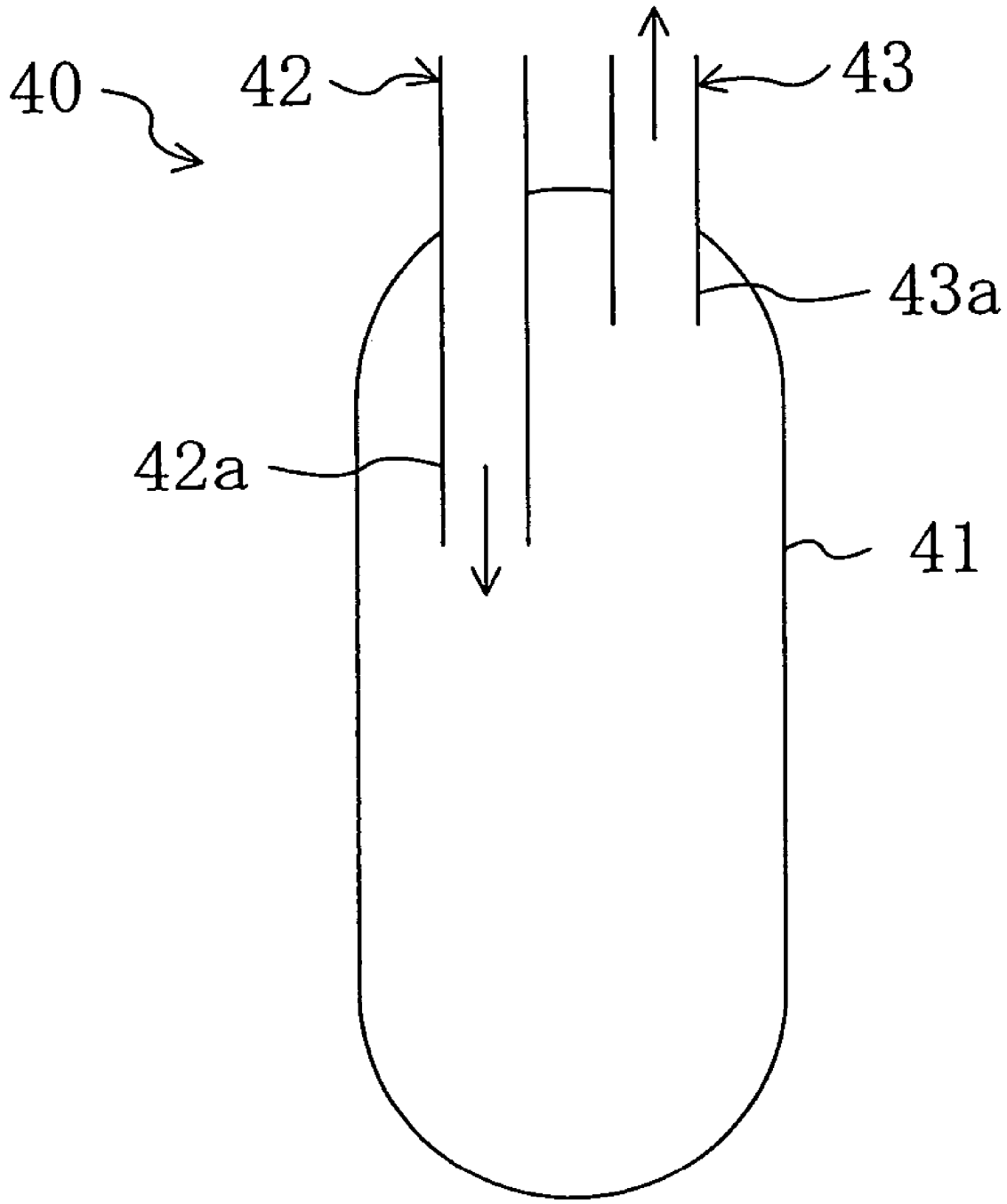
FIG. 3 shows in cross section a schematic structure of a recovery receptacle according to a second embodiment of the present invention.

As shown in FIG. 3, the second embodiment is a modification of the first embodiment, in other words the inflow pipe (42) of the recovery receptacle (40) is modified in location and shape. In addition, unlike the first embodiment, the provision of the baffle plate (44) in the recovery receptacle (40) is omitted.

More specifically, the inflow pipe (42) is connected to an upper portion of the casing (41). The inflow pipe (42) includes a straight pipe part (42*a*) which passes completely through an upper wall portion of the casing (41) and extends vertically. And, a lower end of the straight pipe part (42*a*) is an exit end. The exit end of the inflow pipe (42) is situated near the center of the inside of the casing (41). More specifically, the exit end of the inflow pipe (42) opens towards the inner bottom of the recovery receptacle (40), and is formed, such that it is oriented in the same direction as the entrance end of the outflow pipe (43) without facing the opening of the entrance end of the outflow pipe (43). In addition, the exit end of the inflow pipe (42) is situated at a lower position than the entrance end of the outflow pipe (43).

The recovery receptacle (40) of the second embodiment provides the same operation/working-effect as the recovery receptacle (40) of the first embodiment. To sum up, in the preliminary operation, gas-liquid two-phase refrigerant entered into the recovery receptacle (40) flows and passes through the inflow pipe (42), and is discharged towards the inner bottom of the casing (41). Liquid refrigerant is separated from the discharged refrigerant and is stored at the inner bottom of the casing (41). Then, only gas refrigerant is flowed out into the refrigerant circuit (10) by way of the outflow pipe (43). In addition, in the recovery operation, gas refrigerant entered into the recovery receptacle (40) flows and passes through the inflow pipe (42), and is discharged towards the inner bottom of the casing (41). Contaminants, such as refrigeration oil, are separated from the discharged refrigerant and are attraction-adhered onto the liquid surface of the liquid refrigerant stored in the recovery receptacle (40) by the preliminary operation. And, only gas refrigerant is flowed out into the refrigerant circuit (10) by way of the outflow pipe (43). Consequently, contaminants in the refrigerant pipes are collected in the recovery receptacle (40).

Only the inflow pipe (42) and the outflow pipe (43) are disposed as the componentry within the casing (41) of the recovery receptacle (40) in the second embodiment. The arrangements and the operation/working-effects of other components including the recovery receptacle (40) are the same as in the first embodiment.

Embodiment 3 of Invention

Next, a third embodiment of the present invention will be described in detail with reference to the drawing figures.

Figure 4:
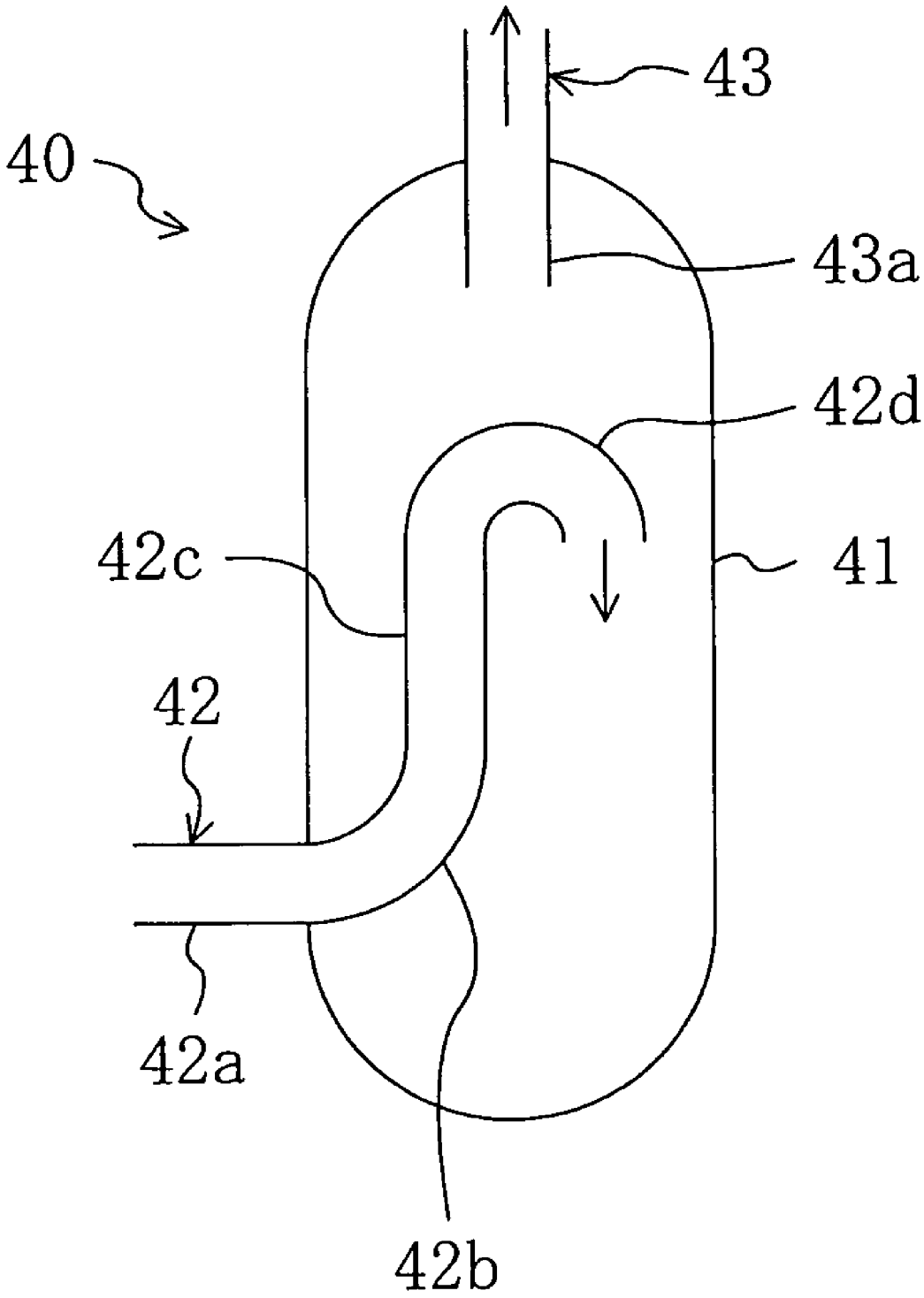
FIG. 4 shows in cross section a schematic structure of a recovery receptacle according to a third embodiment of the present invention.

As shown in FIG. 4, the third embodiment is a modification of the first embodiment, in other words the inflow pipe (42) of the recovery receptacle (40) is modified in location and shape. In addition, unlike the first embodiment, the provision of the baffle plate (44) in the recovery receptacle (40) is omitted.

More specifically, the inflow pipe (42) is connected to a bottom side surface portion of the casing (41). The inflow pipe (42) includes a straight pipe part (42*a*) which passes completely through a side wall portion of the casing (41) and extends horizontally. The straight pipe part (42*a*) includes, at an inner end thereof, an upwardly curved part (42*b*) formed continuously to the inner end. The curved part (42*b*) includes, at an upper end thereof, a straight pipe part (42*c*) formed continuously to the upper end. In addition, the straight pipe part (42*c*) includes, at an upper end thereof, a downwardly curved part (42*d*) formed continuously to the upper end. And, a lower end of the curved part (42*d*) is an exit end. The exit end of the curved part (42*d*) is located centrally in the casing (41). More specifically, the exit end of the inflow pipe (42) opens towards the inner bottom of the recovery receptacle (40), and is formed, such that it is oriented in the same direction as the entrance end of the outflow pipe (43), without facing the opening of the entrance end of the outflow pipe (43). In addition, the exit end of the inflow pipe (42) is situated at a lower position than the entrance end of the outflow pipe (43).

Only the inflow pipe (42) and the outflow pipe (43) are disposed as the componentry within the casing (41) of the recovery receptacle (40) in the second embodiment. The arrangements and the operation/working-effects of other components including the recovery receptacle (40) are the same as in the first embodiment.

Embodiment 4 of Invention

Next, a fourth embodiment of the present invention will be described in detail with reference to the drawing figures.

Figure 5:
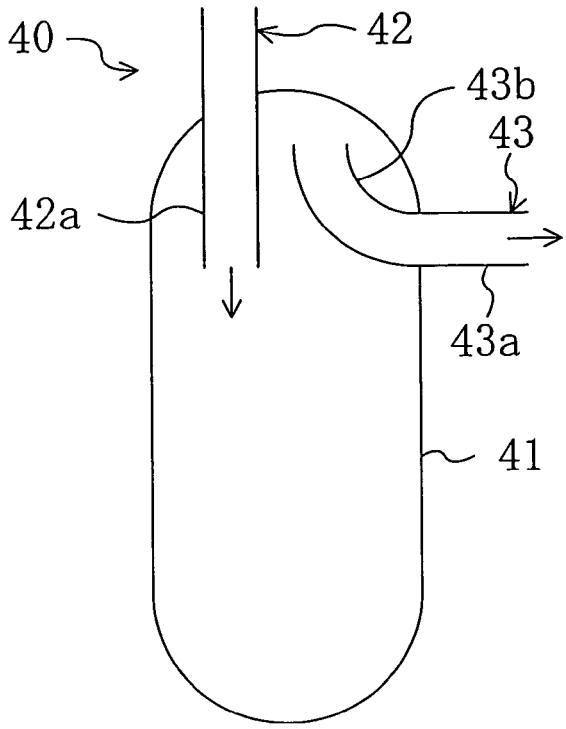
FIG. 5 shows in cross section a schematic structure of a recovery receptacle according to a fourth embodiment of the present invention.

As shown in FIG. 5, the fourth embodiment is a modification of the second embodiment, in other words the outflow pipe (43) of the recovery receptacle (40) is modified in location and shape.

More specifically, the outflow pipe (43) is connected to an upper side surface portion of the casing (41). The outflow pipe (43) includes a straight pipe part (43*a*) which passes completely through a side wall portion of the casing (41) and extends horizontally. The straight pipe part (43*a*) includes, at an inner end thereof, an upwardly curved part (43*b*) formed continuously to the inner end. And, an upper end of the curved part (43*b*) is an entrance end. The entrance end of the curved part (43*b*) is located at a high position in the casing (41). More specifically, the entrance end of the outflow pipe (43) is situated above the exit end of the inflow pipe (42). The entrance end of the outflow pipe (43) and the exit end of the inflow pipe (42) open in opposite directions so that their openings are not oriented face to face with each other.

Such arrangement prevents direct inflow of the refrigerant entered into the recovery receptacle (40) by way of the inflow pipe (42), into the outflow pipe (43).

Only the inflow pipe (42) and the outflow pipe (43) are disposed as the componentry within the casing (41) of the recovery receptacle (40) in the fourth embodiment. The arrangements and the operation/working-effects of other components including the recovery receptacle (40) are the same as in the second embodiment.

Embodiment 5of Invention

Next, a fifth embodiment of the present invention will be described in detail with reference to the drawing figures.

Figure 6:
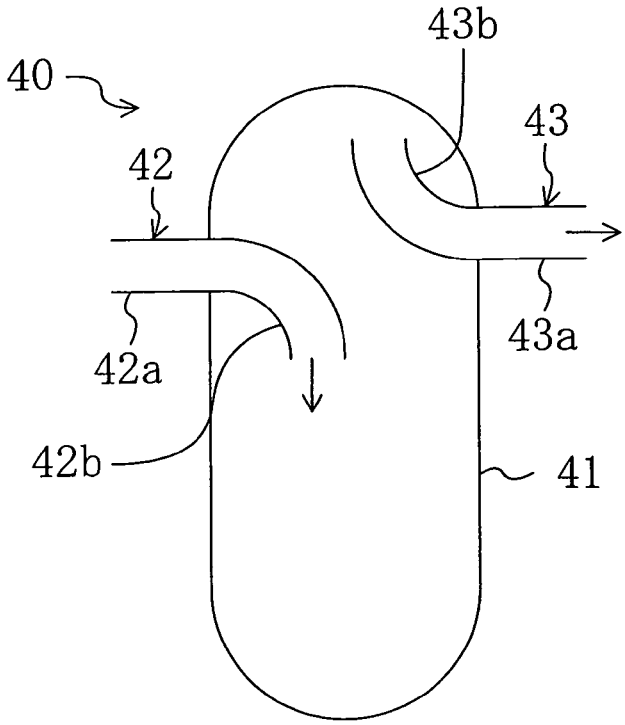
FIG. 6 shows in cross section a schematic structure of a recovery receptacle according to a fifth embodiment of the present invention.

As shown in FIG. 6, the fifth embodiment is a modification as a result of modifying the location and shape of the inflow pipe (42) of the recovery receptacle (40) in the fourth embodiment to the location and shape of the inflow pipe (42) of the recovery receptacle (40) in the first embodiment.

More specifically, the exit end of the inflow pipe (42) is situated below the entrance end of the outflow pipe (43). The exit end of the inflow pipe (42) and the entrance end of the outflow pipe (43) open in opposite directions so that their openings are not oriented face to face with each other.

Only the inflow pipe (42) and the outflow pipe (43) are disposed as the componentry within the casing (41) of the recovery receptacle (40) in the fifth embodiment. The arrangements and the operation/working-effects of other components including the recovery receptacle (40) are the same as in the fourth embodiment.

Embodiment 6 of Invention

Next, a sixth embodiment of the present invention will be described in detail with reference to the drawing figures.

Figure 7:
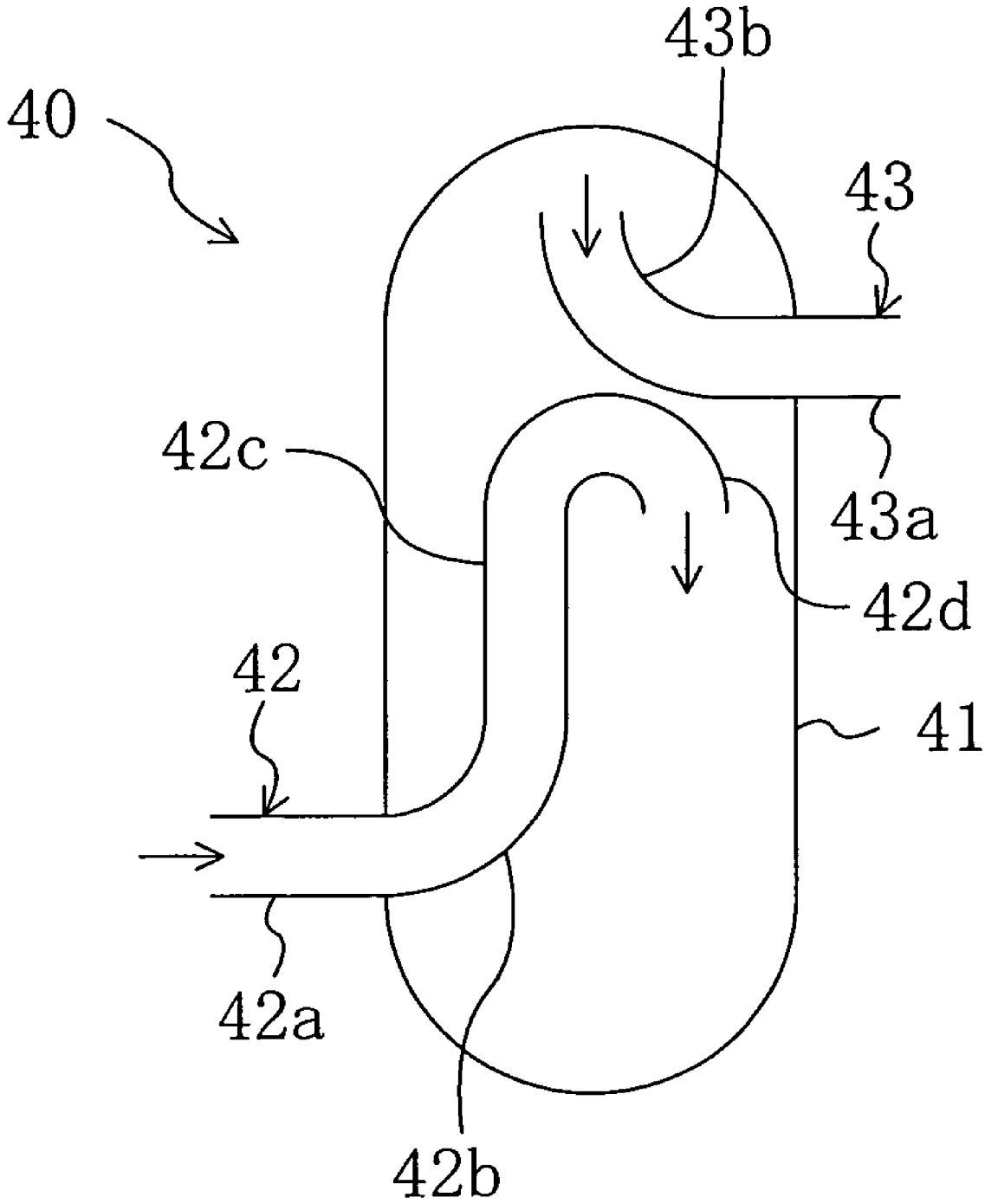
FIG. 7 shows in cross section a schematic structure of a recovery receptacle according to a sixth embodiment of the present invention.
Figure 8:
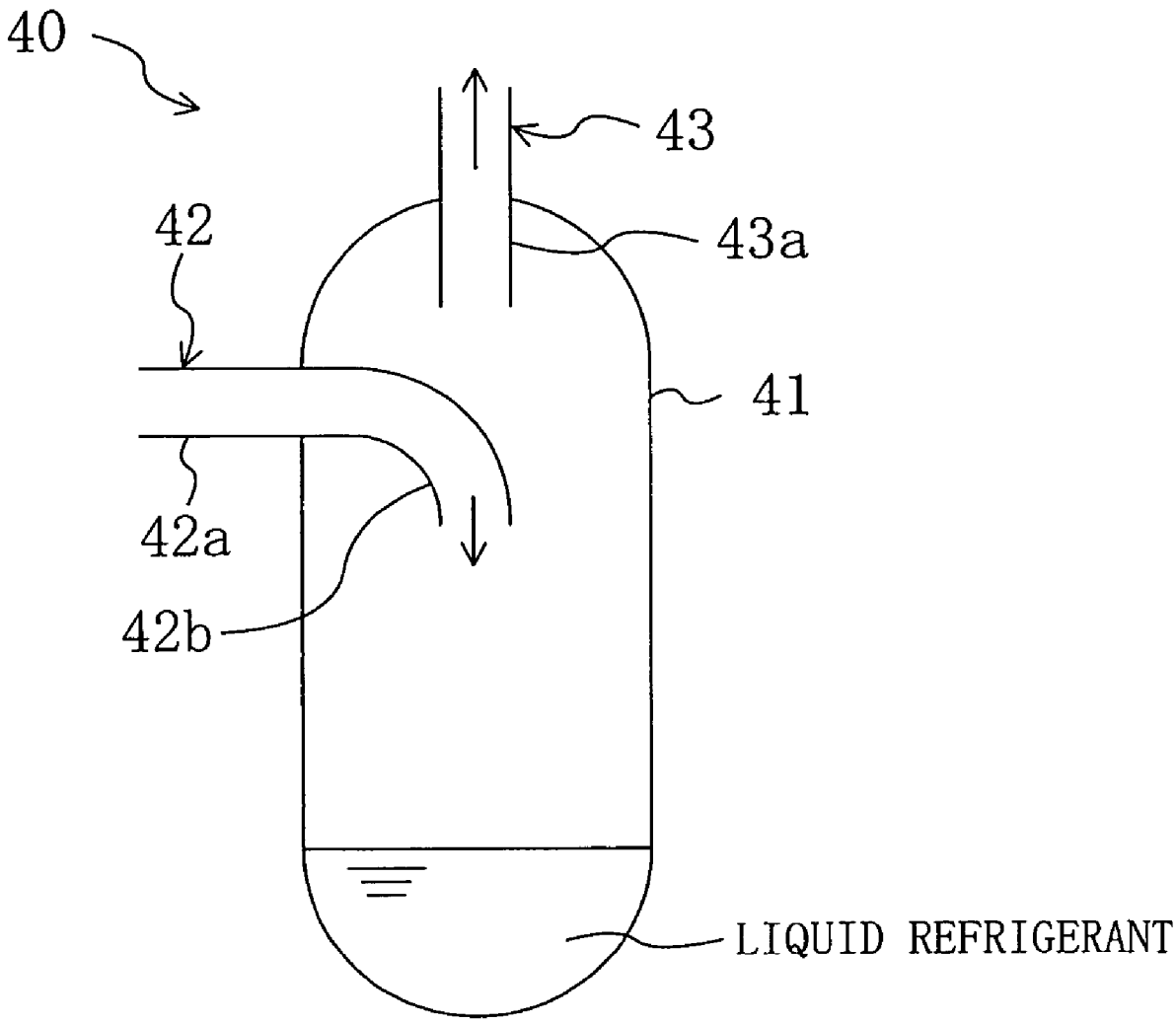
FIG. 8 shows in cross section a schematic structure of a recovery receptacle according to a seventh embodiment of the present invention.

As shown in FIG. 7, the sixth embodiment is a modification as a result of modifying the location and shape of the outflow pipe (43) of the recovery receptacle (40) in the third embodiment to the location and shape of the outflow pipe (43) of the recovery receptacle (40) in the fourth embodiment.

More specifically, the entrance end of the outflow pipe (43) is situated above the exit end of the inflow pipe (42). The entrance end of the outflow pipe (43) and the exit end of the inflow pipe (42) open in opposite directions so that their openings are not oriented face to face with each other.

Such arrangement prevents direct inflow of the refrigerant entered into the recovery receptacle (40) by way of the inflow pipe (42), into the outflow pipe (43).

Only the inflow pipe (42) and the outflow pipe (43) are disposed as the componentry within the casing (41) of the recovery receptacle (40) in the sixth embodiment. The arrangements and the operation/working-effects of other components including the recovery receptacle (40) are the same as in the third embodiment.

Embodiment 7 of Invention

Next, a seventh embodiment of the present invention will be described in detail with reference to the drawing figures.

Unlike the first embodiment in which liquid refrigerant is stored in the recovery receptacle (40) by performing a preliminary operation by control from the preliminary operation means (60), in the present embodiment, however, liquid refrigerant as a contamination-recovery auxiliary liquid is pre-stored in the recovery receptacle (40). Additionally, the provision of the baffle plate (44) in the recovery receptacle (40) is omitted.

To sum up, the preliminary operation is no longer required. Pipe cleaning is accomplished by the recovery operation alone. This makes it possible to aim at reducing the time required for the process of pipe cleaning.

Only the inflow pipe (42), the outflow pipe (43), and the contamination recovery auxiliary liquid are disposed as the componentry within the casing (41) of the recovery receptacle (40) in the seventh embodiment. The arrangements and the operation/working-effects of other components including the recovery receptacle (40) are the same as in the first embodiment.

Embodiment 8 of Invention

Next, an eighth embodiment of the present invention will be described in detail with reference to the drawing figures.

Figure 9:
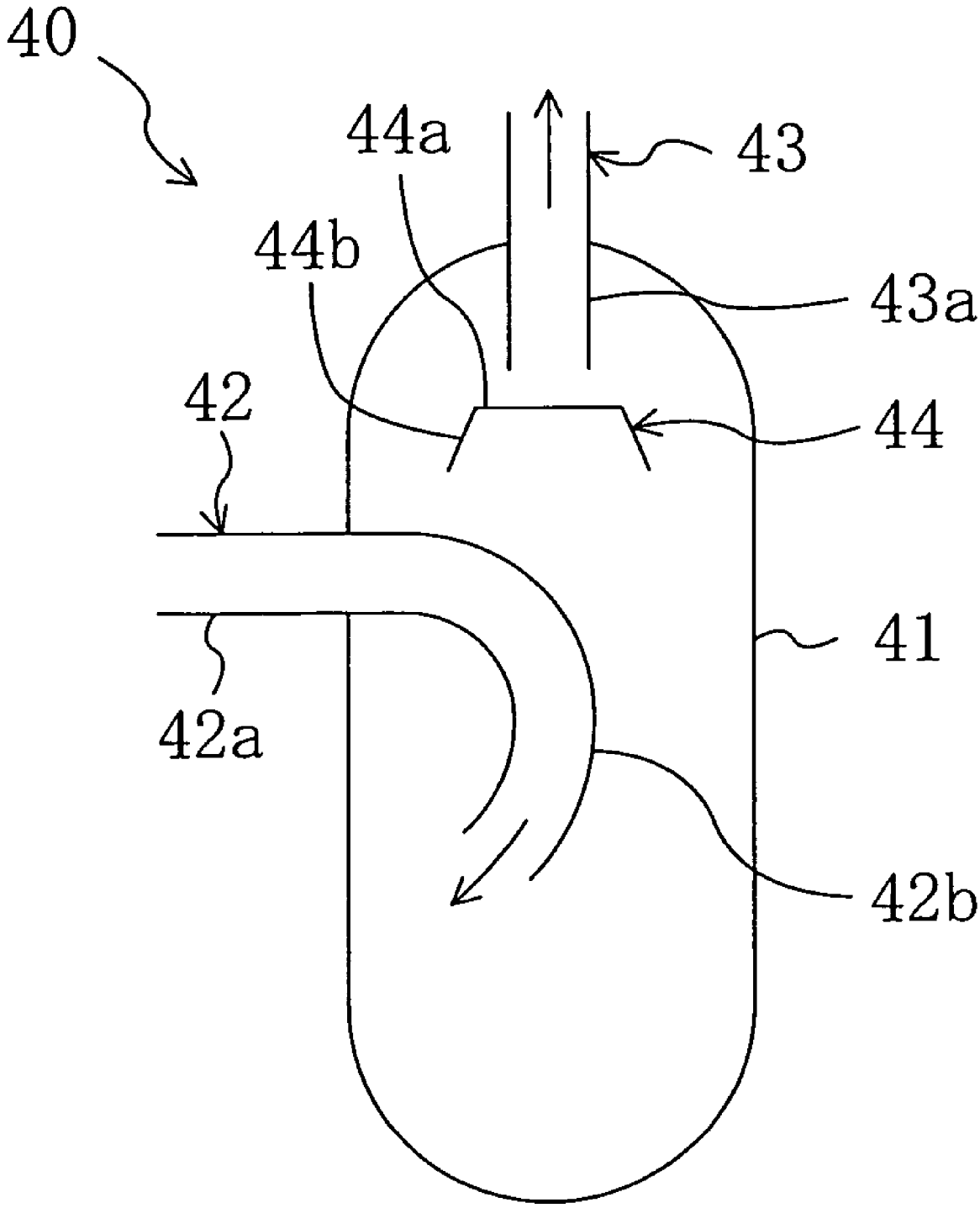
FIG. 9 shows in cross section a schematic structure of a recovery receptacle according to an eighth embodiment of the present invention.

As shown in FIG. 9, the eighth embodiment is a modification of the first embodiment, in other words the inflow pipe (42) of the recovery receptacle (40) is modified in location and shape.

More specifically, the inflow pipe (42) includes a straight pipe part (42*a*) which is connected to an upper side surface portion of the casing (41) and which extends horizontally. The straight pipe part (42*a*) passes completely through a side wall portion of the casing (41), and is introduced into the casing (41). Furthermore, the straight pipe part (42*a*) includes, at an inner end thereof, an approximately U-curved part (42*b*) formed continuously to the inner end. The curved part (42*b*) curves at an angle of about 180 degrees from the straight pipe part (42*a*) and its lower end which is the exit end of the inflow pipe (42) opens obliquely downwardly. In other words, the exit end of the inflow pipe (42) opens to the side wall of the casing (41).

Other arrangements, such as the arrangement of the refrigerant circuit (10), the arrangement of the outflow pipe (43), and the arrangement of the baffle plate (44), are the same as in the first embodiment.

As the result of the above arrangements, gas refrigerant is discharged obliquely downwardly from the inflow pipe (42) in the recovery receptacle (40). At that time, even when contaminants separated from the gas refrigerant rebound upwardly to near the entrance end of the outflow pipe (43), the baffle plate (44) serves as an obstacle against the contaminants. Therefore, the contaminants will not be flowed out through the outflow pipe (43). As the result of this, it is ensured that contaminants in the refrigerant pipes are collected in the recovery receptacle (40). Other operation/working-effects are the same as in the first embodiment.

The curved part (42*b*) of the inflow pipe (42) in the present embodiment may be curved in any other direction. In other words, it may be arranged that the curved part (42*b*) of the inflow pipe (42) is curved at an angle of about 30 degrees from the straight pipe part (42*a*) so that the exit end of the inflow pipe (42) opens obliquely downwardly towards the right-hand side wall of the casing (41).

Other Embodiments of Invention

With respect to each of the foregoing embodiments, the present invention may be configured as follows.

In each of the foregoing embodiments, by controlling the degree of opening of each indoor expansion valve (32) in the preliminary operation, refrigerant is circulated in a gas-liquid two-phase state after leaving the indoor heat exchanger (33). For example, it may be arranged in the present invention that the indoor fan (33*a*) of each indoor heat exchanger (33) is stopped. In this case, since each indoor heat exchanger (33) is not supplied with indoor air, the evaporation amount of refrigerant in the indoor heat exchanger (33) is reduced, thereby ensuring that refrigerant is entered into a gas-liquid two-phase state.

Besides, it may be arranged that the frequency of the compressor (21) falls below a predetermined value. In this case, the amount of refrigerant drawn into the compressor (21) is reduced and the amount of refrigerant in the indoor heat exchanger (33) apparently increases. Consequently, by the same operation as the case where the degree of opening of the indoor expansion valve (32) is controlled, it becomes possible to cause refrigerant to circulate in a gas-liquid two-phase state after leaving the indoor heat exchanger (33).

Additionally, it is needless to say that the baffle plate (44) may be provided within the recovery receptacle (40) in each of the second to seventh embodiments, as in the first embodiment.

Furthermore, in each of the foregoing embodiments, the description has been made in terms of an example in which the number of indoor units (30) is three. Alternatively, one or more indoor units (30) may of course be used.

In addition, the present invention may be applied to other than air conditioning apparatus. For example, the present invention is applicable to various types of refrigeration apparatuses.

Finally, it may be arranged that the exit end of the inflow pipe (42) is oriented so as to open obliquely downwardly towards the side wall of the casing (41) in each of the second to seventh embodiments, as in the eighth embodiment.

INDUSTRIAL APPLICABILITY

As has been described above, the present invention is suitably applicable to refrigeration apparatuses which perform refrigerant pipe cleaning operations. The present invention is especially suitable for the case where refrigeration apparatuses are renewed.

What is claimed is:

1. A refrigeration apparatus, comprising (a) a refrigerant circuit (10) for execution of a vapor compression refrigeration cycle including a compressor (21), a heat source side heat exchanger (24), and a utilization side heat exchanger (33) which are connected by a refrigerant pipe and (b) a contaminant recovery receptacle (40) which is connected to the suction side of the compressor (21) by an inflow pipe (42) and an outflow pipe (43), for recovering contaminants in the recovery receptacle (40) by causing refrigerant to circulate in the refrigerant circuit (10) so that gaseous refrigerant flows into the recovery receptacle (40), wherein the inflow pipe (42) has an exit end which opens downwardly or obliquely downwardly in the recovery receptacle (40) while, on the other hand, the outflow pipe (43) has an entrance end which is situated above the exit end of the inflow pipe (42) in the recovery receptacle (40), and wherein a baffle plate (44) against contaminants is so disposed as to be situated face to face with the entrance end of the outflow pipe (43) at a predetermined distance apart therefrom in the recovery receptacle (40).

2. A refrigeration apparatus, comprising (a) a refrigerant circuit (10) for execution of a vapor compression refrigeration cycle including a compressor (21) a heat source side heat exchanger (24) and a utilization side heat exchanger (33) which are connected by a refrigerant pipe and (b) a contaminant recovery receptacle (40) which is connected to the suction side of the compressor (21) b an inflow pipe (42) and an outflow pipe (43), for recovering contaminants in the recovery receptacle (40) by causing refrigerant to circulate in the refrigerant circuit (10) so tat gaseous refrigerant flows into the recovery receptacle (40), wherein the inflow pipe (42) has an exit end which opens downwardly or obliquely downwardly in the recovery receptacle (40) while, on the other hand, the outflow pipe (43) has an entrance end which is situated above the exit end of the inflow pipe (42) in the recovery receptacle (40), and comprising switching means (50) for switching the circulation of refrigerant in the refrigerant circuit (10) so that the refrigerant is either circulated to flow through the recovery receptacle (40), or circulated to bypass the recovery receptacle (40), wherein the switching means (50) is made up of:

opening/closing valves (51, 52) disposed, respectively, in the inflow and outflow pipes (42, 43) of the recovery receptacle (40), and an opening/closing valve (53) disposed between a connection part of the inflow pipe (42) and a connection part of the outflow pipe (43) of the recovery receptacle (40) in a refrigerant pipe on the suction side of the compressor (21).

3. A refrigeration apparatus, comprising (a) a refrigerant circuit (10) for execution of a vapor compression refrigeration cycle including a compressor (21), a heat source side heat exchanger (24), and a utilization side heat exchanger (33) which are connected by a refrigerant pipe and (b) a contaminant recovery receptacle (40) which is connected to the suction side of the compressor (21) by an inflow pipe (42) and an outflow pipe (43), for recovering contaminants in the recovery receptacle (40) by causing refrigerant to circulate in the refrigerant circuit (10) so that gaseous refrigerant flows into the recovery receptacle (40), wherein the inflow pipe (42) has an exit end which opens downwardly or obliquely downwardly in the recovery receptacle (40) while, on the other hand, the outflow pipe (43) has an entrance end which is situated above the exit end of the inflow pipe (42) in the recovery receptacle (40), and wherein:

an auxiliary liquid for the recovery of contaminants is pre-stored in the recovery receptacle (40), and the exit end of the inflow pipe (42) of the recovery receptacle (40) is situated at a predetermined distance apart from the storage surface of the contaminant-recovery auxiliary liquid.

4. A refrigeration apparatus, comprising (a) a refrigerant circuit (10) for execution of a vapor compression refrigeration cycle including a compressor (21), a heat source side heat exchanger (24), and a utilization side heat exchanger (33) which are connected by a refrigerant pipe and (b) a contaminant recovery receptacle (40) which is connected to the suction side of the compressor (21) by an inflow pipe (42) and an outflow pipe (43), for recovering contaminants in the recovery receptacle (40) by causing refrigerant to circulate in the refrigerant circuit (10) so that gaseous refrigerant flows into the recovery receptacle (40), wherein the inflow pipe (42) has an exit end which opens downwardly or obliquely downwardly in the recovery receptacle (40) while, on the other hand, the outflow pipe (43) has an entrance end which is situated above the exit end of the inflow pipe (42) in the recovery receptacle (40), and comprising:

preliminary operation means (60) for causing refrigerant to circulate in the refrigerant circuit (10) for a predetermined length of time so that a two-phase refrigerant mixture of liquid refrigerant and gas refrigerant flows into the recovery receptacle (40), and recovery operation means (70) for causing refrigerant to circulate in the refrigerant circuit (10) so that upon completion of the operation of the preliminary operation means (60), gaseous refrigerant flows into the recovery receptacle (40).

5. The refrigeration apparatus of claim 4 wherein the preliminary operation means (60) increases the degree of opening of an expansion valve (32) disposed between the heat source side heat exchanger (24) and the utilization side heat exchanger (33).

6. The refrigeration apparatus of claim 4 wherein the preliminary operation means (60) stops a utilization side fan of the utilization side heat exchanger (33).

7. The refrigeration apparatus of claim 4 wherein the preliminary operation means (60) lowers the frequency of the compressor (21) to below a predetermined value.

* * * * *

UNITED STATES PATENT AND TRADEMARK OFFICE

CERTIFICATE OF CORRECTION

PATENT NO. : 7,497,091 B2
APPLICATION NO. : 10/551193
DATED : March 3, 2009
INVENTOR(S) : Manabu Yoshimi et al.

It is certified that error appears in the above-identified patent and that said Letters Patent is hereby corrected as shown below:

Title Page, Item (54) Title, and Col. 1, Line 1, should read:

"REFRIGERATION APPARATUS"

Signed and Sealed this

Twenty-third Day of June, 2009

JOHN DOLL
*Acting Director of the United States Patent and Trademark Office*